United States Patent [19]

Inomata

[11] Patent Number: 4,712,987

[45] Date of Patent: Dec. 15, 1987

[54] VANE COMPRESSOR PROVIDED WITH ENDLESS CAMMING SURFACE MINIMIZING TORQUE FLUCTUATIONS

[75] Inventor: Kenichi Inomata, Konan, Japan

[73] Assignee: Diesel Kiki Co., Ltd., Tokyo, Japan

[21] Appl. No.: 862,758

[22] Filed: May 13, 1986

[30] Foreign Application Priority Data

May 22, 1985 [JP] Japan ..... 60-108358

[51] Int. Cl.[4] ..... F04C 18/344

[52] U.S. Cl. ..... 418/150

[58] Field of Search ..... 418/150, 259

[56] References Cited

U.S. PATENT DOCUMENTS 2,791,185 5/1957 Bohnhoff et al. ..... 418/150

4,480,973 11/1984 Ishizuka ..... 418/150

4,501,537 2/1985 Ishizuka ..... 418/150

*Primary Examiner*—John J. Vrablik

*Attorney, Agent, or Firm*—Frishauf, Holtz, Goodman & Woodward

[57] ABSTRACT

The endless camming inner peripheral surface of the pump housing, which performs one cycle of suction, compression and discharge of fluid in cooperation with the vanes and the rotor, has a cam profile including an increasing radius portion along which the amount of protrusion of each vane from the rotor gradually increases with movement of the vane, and a decreasing radius portion along which the amount of protrusion of each vane from the rotor gradually decreases with movement of the vane. The increasing radius portion and the decreasing radius portion are continuously arranged in the order mentioned and in the moving direction of the vanes. The increasing radius portion terminates in a first half of the whole circumferential length of the one cycle performing portion of the endless camming inner peripheral surface. The cam profile of the one cycle performing portion of the camming surface is calculated by the use of a single equation.

9 Claims, 11 Drawing Figures

FIG. 5

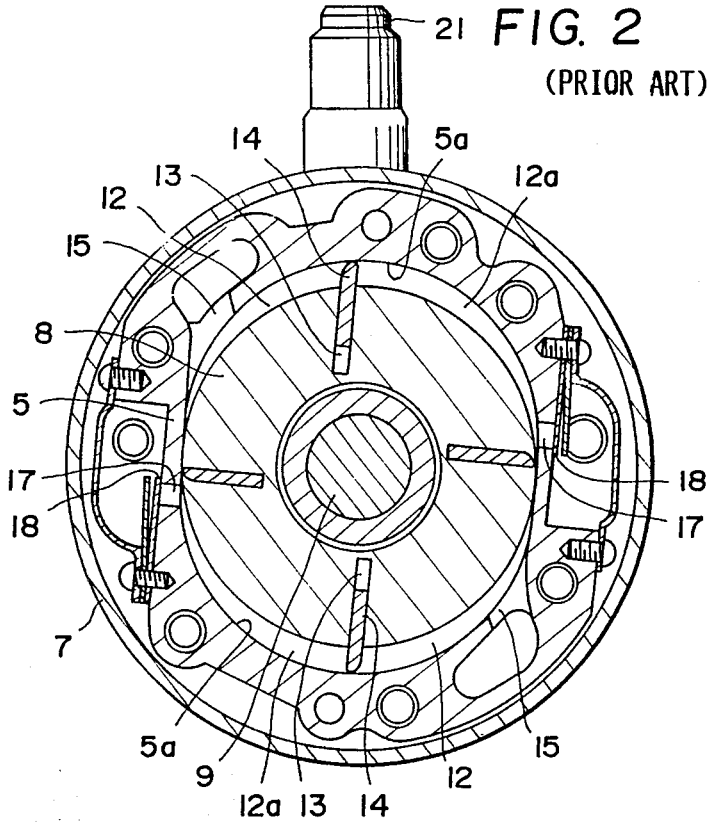
FIG. 2
(PRIOR ART)
FIG. 3
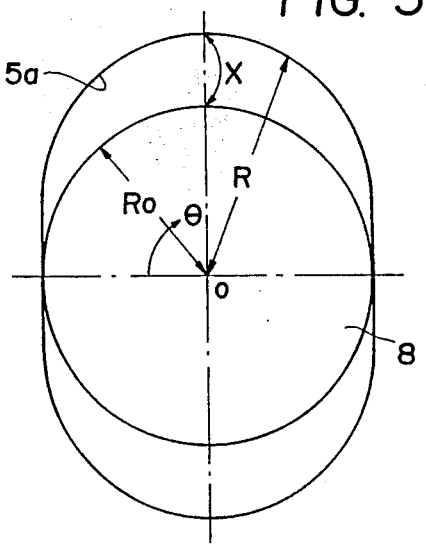

VANE COMPRESSOR PROVIDED WITH ENDLESS CAMMING SURFACE MINIMIZING TORQUE FLUCTUATIONS

BACKGROUND OF THE INVENTION

This invention relates to vane compressors adapted for use in air conditioning systems or the like, and more particularly to vane compressors of this kind provided with improved camming surfaces which minimize torque fluctuations.

In a vane compressor in general, in which a rotor and vanes carried on the rotor are received in a pump housing having an inner peripheral surface formed as an endless camming surface, the endless camming surface along which the vanes slidingly move together with the rotating rotor, has an elliptical cam profile in the type where the pump housing has two pumping chambers defined therein, and a circular cam profile in the type where the pump housing has a single pumping chamber defined therein.

However, conventionally no particular consideration was given to minimizing fluctuations in the torque acting upon the rotor in designing the cam profile of the endless camming surface. Therefore, the conventional vane compressor has large torque fluctuations during each cycle of suction, compression and discharge of fluid, which causes occurrence of operating noise and vibrations of the compressor during operation of the compressor.

It has previously been recognized by U.S. Pat. No. 4,480,973 assigned to the same assignee of the present application that a cam profile satisfying the below-mentioned requirements can minimize the torque fluctuations:

(1) The compressor stroke length should be as large as possible;

(2) The timing of an increase in the compressing pressure in an initial low torque region of each operating cycle should be advanced so as to obtain increased overlapped portions of the torque curves obtained by the individual vanes. Consequently, the torque fluctuations obtained by the individual vanes are averaged to provide a generally flattened torque curve; and (3) The amount of protrusion of each vane from the rotor should be small enough to effectively reduce the value of peak torque during the high pressure compression stroke.

In order to satisfy these requirements, the above-mentioned U.S. patent has proposed a camming surface comprised of a plurality of successively arranged curves having respective cam profiles obtained by different equations. However, according to the proposed camming surface, adjacent ones of the curves have their joining portions different in curvature from each other, which can cause jumping of vanes and consequent chattering of same and damage to the tip of vanes or the camming surface.

SUMMARY OF THE INVENTION

It is therefore the object of the invention to provide a vane compressor in which the endless camming surface is so configurated as to minimize the torque fluctuations and consequently eliminate the possibility of jumping of vanes.

According to the present invention, the endless camming inner peripheral surface of the pump housing has at least one portion for performing one cycle of suction, compression and discharge of fluid in cooperation with the vanes and the rotor, which portion has a cam profile including an increasing radius portion along which the amount of protrusion of each vane from the rotor gradually increases with movement of the vane; and a decreasing radius portion along which the amount of protrusion of each vane from the rotor gradually decreases with movement of the vane. The increasing radius portion and the decreasing radius portion are continuously arranged in the order mentioned and in the moving direction of the vanes. The increasing radius portion terminates in a first half of the whole circumferential length of the one cycle performing portion of the endless camming inner peripheral surface of the pump housing. The cam profile of the one cycle performing portion of the camming surface is calculated by the use of a single equation.

The above and other objects, features and advantages of the invention will be more apparent from the ensuing detailed description taken in conjunction with the accompanying drawings.

BRIEF DESCRIPTION OF THE DRAWINGS

FIG. 2 is a sectional view taken along line II—II in FIG. 1;

FIG. 3 is a schematic view showing a whole cam profile of the camming inner peripheral surface and the rotor according to the present invention;

DETAILED DESCRIPTION

Figure 1:
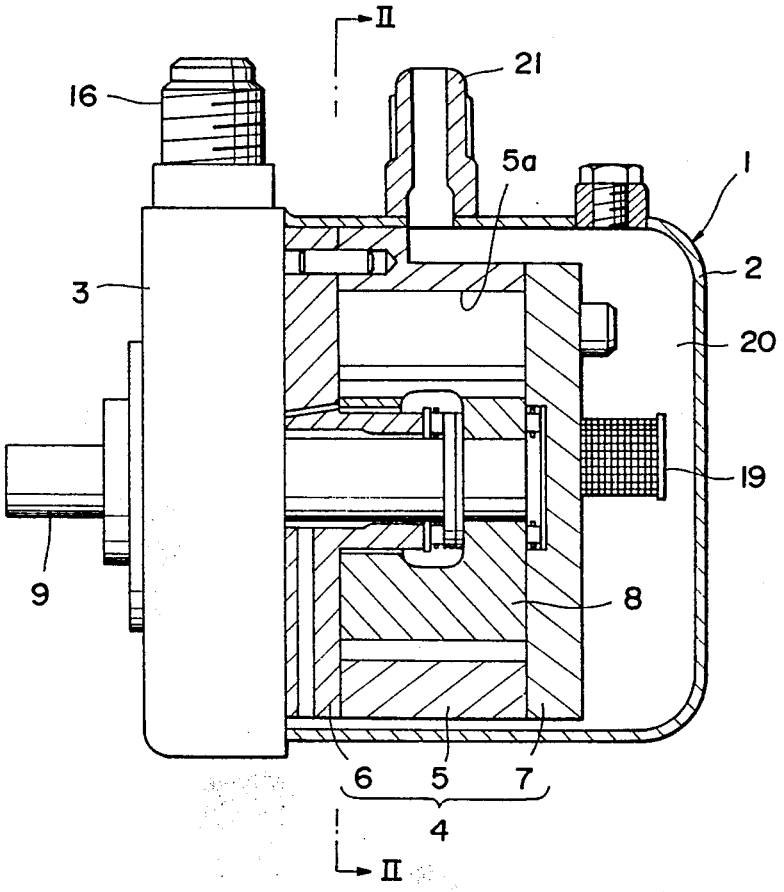
FIG. 1 (PRIOR ART)
FIG. 1 is a side view of a typical conventional vane compressor of the double pumping chamber type, with its essential part shown in longitudinal section.

Referring to FIGS. 1 and 2, there is illustrated a typical conventional vane compressor having two pumping chambers. In the figures, reference numeral 1 is a compressor casing, which is comprised of a cylindrical shell 2, and a front head 3 fitted in an open end of the shell 2 in a manner closing same. A pump housing 4 is accommodated within the casing 1 and is comprised of a cam ring 5, and a front side block 6 and a rear side block 7 secured to both sides of the cam ring 5. Rotatably fitted in the pump housing 4 is a cylindrical rotor 8 which is securedly fitted on a drive shaft 9. Two pumping chambers 12 and 12 are defined at diametrically opposite locations between the outer peripheral surface of the rotor 8, the inner peripheral surface 5*a* of the cam ring 5, and the inner surfaces of the side blocks 6, 7. The rotor 8 has its outer peripheral surface formed therein with a plurality of, e.g. four, axial slits 13 circumferentially arranged at equal intervals and carries as many plate-like vanes 14 radially movably fitted in the respective slits 13. As the drive shaft 9 rotates, the rotor 8 is rotated together with the drive shaft 9. A centrifugal force produced by the rotation of the rotor 8 and back pressure of lubricant oil acting upon the vanes 14 at the bottoms of the slits 13 cooperate to radially outwardly force the vanes 14 into sliding contact at their tips with the camming inner peripheral surface 5*a* in a clockwise circumferential direction as viewed in FIG. 2 in unison with the rotor 8. Each time one of the vanes 14 passes by a pump inlet 15 formed in the peripheral wall of the cam ring 5, compressing fluid is sucked into a pumping chamber 12 through a suction connector 16 provided on the front head 3. Each pumping chamber 12 has its spatial volume varying from a minimum value to a maximum value during the suction stroke, and varying from a maximum value to a minimum value during the compression stroke. The fluid thus sucked into the chamber 12 and compressed therein is discharged through a pump outlet 17 and a discharge valve 18 forcedly opened by the compressed fluid. The above operating cycle is repeated. The compressed fluid is discharged into a delivery pressure chamber 20 defined between the pump housing 4 and the compressor casing 1, after having lubricant oil mixed therein separated therefrom by a lubricant oil separator 19, and then is delivered through a discharge connector 21 mounted on the shell 2 into an external circuit, not shown, after temporary staying in the chamber 20.

In the vane compressor having the above-described arrangement and operation, the cam profile is not adapted for reducing the torque fluctuations, and therefore the compressor undergoes large torque fluctuations during each cycle of suction, compression and discharge of fluid, resulting in the ocurrence of operating noise and vibrations of the compressor, as noted before.

The present invention will now be described in detail with reference to FIGS. 3 through 11 showing several embodiments thereof. The compressors according to the embodiments of the invention shown in FIGS. 3 through 11 are substantially identical in basic construction with the conventional vane compressor shown in FIGS. 1 and 2, except for the cam profile, and therefore description of the basic structure is omitted, while only description of the basic structure is omitted, while only description of the cam profile will now be made.

Reference is first made to FIG. 3 which is useful in explaining symbols used in the embodiments shown in FIGS. 4 through 11, and schematically shows the whole cam profile of the camming inner peripheral surface and the rotor according to the invention, which is applied to the double pumping chamber type. In the figure, symbol Ro represents the radius of the rotor 8, R the distance between the diametric center 0 of the rotor 8 and the camming inner peripheral surface 5*a*, X the amount of protrusion of each vane, and $\theta$ the angle through which each vane is rotated, i.e. the angle at which tip of the vane lies apart from the starting end of the one cycle performing portion with respect to the rotor center. One operating cycle of suction, compression and discharge of fluid is effected each time the vanes move through 180 degrees along a half portion of the outer peripheral surface of the rotor 8, that is, two such cycles are carried out each time the rotor rotates through 360 degrees.

Figure 4:
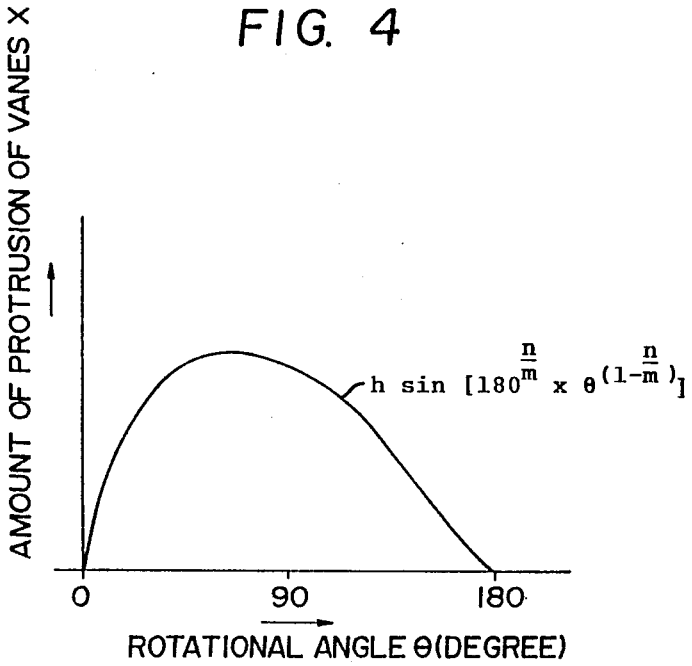
FIG. 4 is a graph showing the relationship between the amount of protrusion of each vane and the rotational angle of the vane in accordance with a cam profile according to a first embodiment of the invention.
Figure 5:
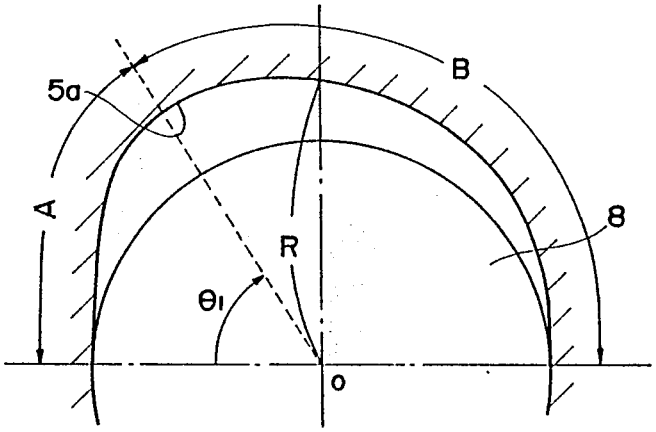
FIG. 5 is a schematic view showing the cam profile based upon the protrusion amount characteristic of FIG. 4.

FIGS. 4 and 5 show a first embodiment of the invention, wherein FIG. 4 shows the amount X of protrusion of each vane plotted with respect to the angle $\theta$ through which the vane revolves, and FIG. 5 a cam profile resulting from the protrusion amount characteristic of FIG. 4. The cam profile according to the invention including this embodiment satisfies the aforementioned requirements (1)–(3). That is, (1) To make the compression stroke as large as possible;

(2) To advance the timing of an increase in the compressing pressure in an initial low torque region of each operating cycle so as to obtain increased overlapped portions of the torque curves obtained by the individual vanes and thus provide a generally flattened torque curve; and (3) To keep the vane protrusion amount small enough to effectively reduce the value of peak torque during the high pressure compression stroke.

A cam profile that satisfies all the above requirements should be configuirated to include an increasing radius portion A along which the amount of protrusion of each vane from the rotor gradually increases with movement of the vane, and a decreasing radius portion B along which the amount of protrusion of each vane from the rotor gradually decreases with movement of the vane. The increasing radius portion A and the decreasing radius portion B are continuously arranged in the order mentioned and in the moving direction of the vanes. The increasing radius portion A, which circumferentially extends from 0 degree to $\theta_1$ as shown in FIG. 5, should terminate in a first half of the whole circumferential length of the one cycle performing portion of the endless camming inner peripheral surface of the pump housing, so as to achieve an advanced timing of the increase of the compression pressure (fluid pressure in the pumping chamber 12) in the initial low torque region of one operating cycle. On the other hand, the decreasing radius portion B should have its proportion of the camming inner peripheral surface for one operating cycle set at a value as large as possible. It has been proposed by U.S. Pat. No. 4,480,973, hereinbefore referred to, to employ a sine curve or a like curve for each of the increasing radius portion and the decreasing radius portion to follow so as to enable smooth shifting from one camming surface portion to the next one. Indeed, it has been recognized that by providing the increasing radius portion A and the decreasing radius portion B with such sine curve cam profiles, the vanes can slidingly move from one curved camming surface portion to the next one with their amounts of protrusion varying in a streamline manner and by a slight amount, and that if the decreasing radius portion have the above-stated large length proportion and cam profile, the vanes have very low receding velocity or velocity of radially inward movement and also have their amounts of protrusion kept low enough to provide very low peak torque in sliding movement along the decreasing radius portion during the compression stroke, and the torque curves obtained by the individual vanes have large overlapped portions to provide an even or flat torque curve, substantially reducing the total torque fluctuations. It has, however, been found by the present inventor that it will be more advantageous to achieve the above-mentioned results in a more perfect manner nad particularly effective to prevent the vanes from jumping upon transition from one camming surface portion to the next one if the incresing radius portion A and the decreasing radius portion B have such a combined or continuous cam profile that the vane protrusion amount X, i.e. the distance between the camming inner peripheral surface and the center 0 of the rotor varies along a continuous sine curve or a continuous like curve such as a combination of sine curves and a combination of a sine curve and a cosine curve throughout the whole circumferential length of the one cycle performing portion of the camming inner peripheral surface from the starting end to the terminating end. To this end, according to the invention, the cam profile of the one cycle performing portion of the camming surface is calculated by the use of a single equation so as to eliminate the phenomenon that the vanes jump.

Reverting to FIGS. 4 and 5, the vane protrusion amount X for the whole camming surface of the increasing radius portion A and the decreasing radius portion B, is determined by the following single equation utilizing trigonometric functions:

$$X = h \sin\left[180^{\frac{n}{m}} \times \theta^{(1-\frac{n}{m})}\right]$$

where h is a constant which determines the maximum amount of protrusion of vanes, and n and m are constants which determine the proportion in circumferential length between the increasing radius portion and the decreasing radius portion so as to satisfy the above stated requirements relating to the length proportions of the camming surface portions. The distance between the center 0 of the rotor 8 and the camming inner peripheral surface 5*a* is therefore expressed by the following single equation:

$$R = Ro + h \sin\left[180^{\frac{n}{m}} \times \theta^{(1-\frac{n}{m})}\right]$$

For example, n is set at 1, and m is set at 4. Thus, the distance R in this embodiment is expressed as follows:

$$R = Ro + h \sin(180^{\frac{1}{4}} \times \theta^{\frac{3}{4}})$$

The curve of FIG. 4 is calculated by this equation, upon which the cam profile of FIG. 5 is based.

Since the cam profile of the camming inner peripheral surface 5*a* of FIG. 5 is obtained by the single equation, the surface 5*a* is formed of a sine curve extending smoothly continuously over the whole circumferential length of the one cycle performing portion, thus being free from jumping of the vanes which would otherwise cause chattering of the vanes and damage to the vanes.

Figure 6:
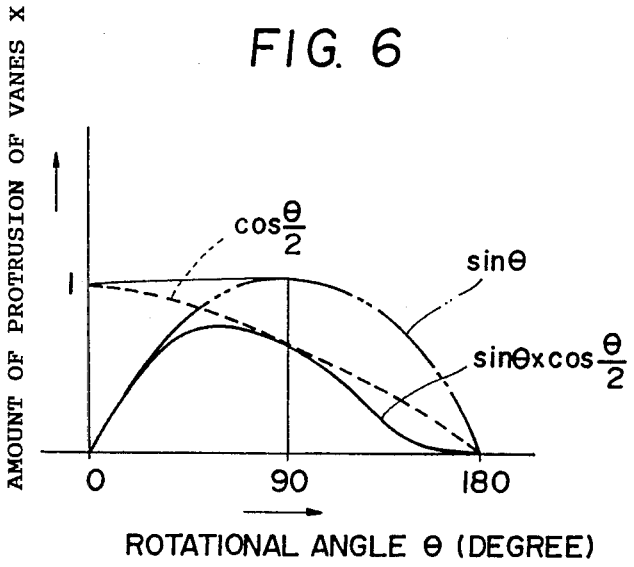
FIG. 6 is a view similar to FIG. 4, but showing a second embodiment of the invention.
Figure 7:
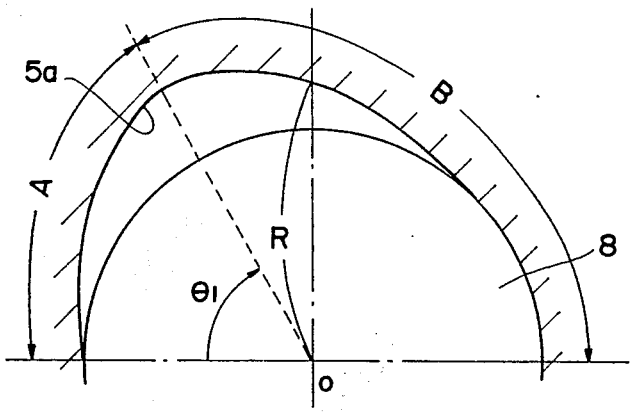
FIG. 7 is a view similar to FIG. 5, but showing the cam profile based upon the characteristic of FIG. 6.

FIGS. 6 and 7 show a second embodiment of the invention. According to this embodiment, the vane protrusion amount of X is calculated by the following single equation:

$$X = a \sin^m\theta \times \cos^n\frac{\theta}{2}$$

where a is a constant which determines the maximum amount of protrusion of the vanes.

The distance R between the center 0 of the rotor 8 and the camming inner peripheral surface 5*a* is therefore expressed by the following single equation:

$$R = \mathrm{Ro} + a \sin^m\theta \times \cos^n\frac{\theta}{2}$$

To satisfy the aforementioned requirements, the values n and m are both set at 1 in this embodiment. Thus, the distance R between the center 0 of the rotor 8 and the camming inner peripheral surface 5*a* is expressed as follows:

$$R = \mathrm{Ro} + a \sin\theta \times \cos\frac{\theta}{2}$$

The curve of FIG. 6 is calculated by this equation, and is therefore a combination or synthetic curve of a sine curve and a cosine curve, upon which the cam profile of FIG. 7 is based.

Figure 8:
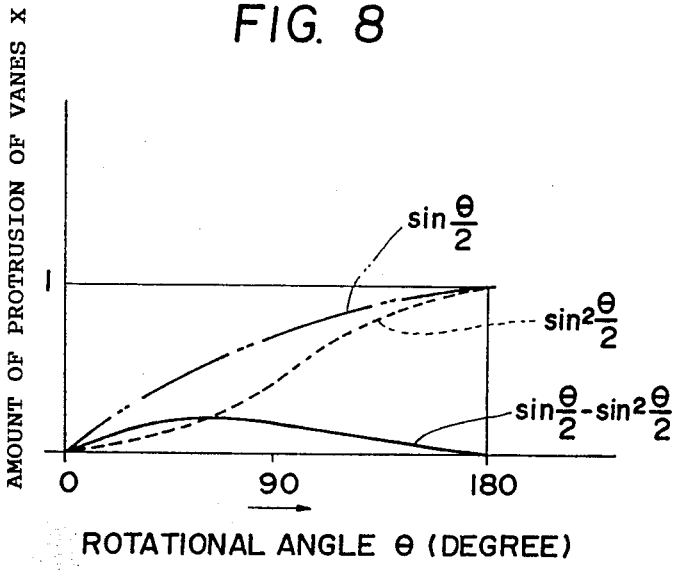
FIG. 8 is a view similar to FIG. 4, but showing a third embodiment of the invention.
Figure 9:
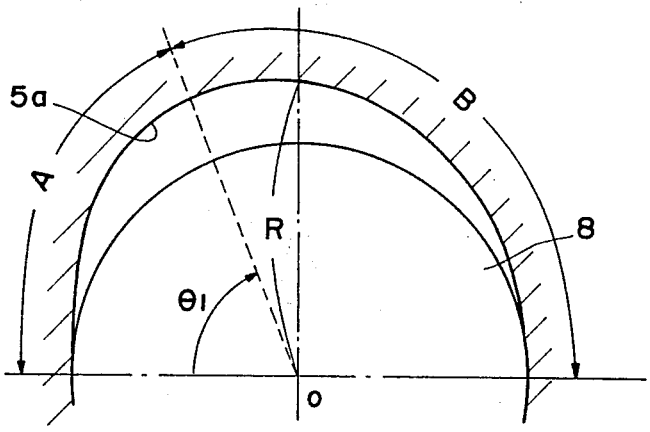
FIG. 9 is a view similar to FIG. 5, but showing the cam profile based upon the characteristic of FIG. 8.

FIGS. 8 and 9 show a third embodiment of the invention. According to this embodiment, the vane protrusion amount X is calculated by the following single equation:

$$X = b\left(\sin^m\frac{\theta}{2} - \sin^n\frac{\theta}{2}\right)$$

where b is a constant which determines the maximum protrusion amount of the vanes, and n is larger than m. In this embodiment, n is set at 2, and m 1, respectively, to satisfy the aforementioned requirements relating to the length proportions of the increasing radius portion and the decreasing radius portion. Thus, the distance R between the center 0 of the rotor 8 and the camming inner peripheral surface 5*a* is expressed as follows:

$$R = Ro + b\left(\sin^m\frac{\theta}{2} - \sin^n\frac{\theta}{2}\right) = Ro + b\left(\sin\frac{\theta}{2} - \sin^2\frac{\theta}{2}\right)$$

The curve of FIG. 8 is calculated by this equation, and is therefore a combination or synthetic curve of two sine curves, upon which the cam profile of FIG. 9 is based.

Figure 10:
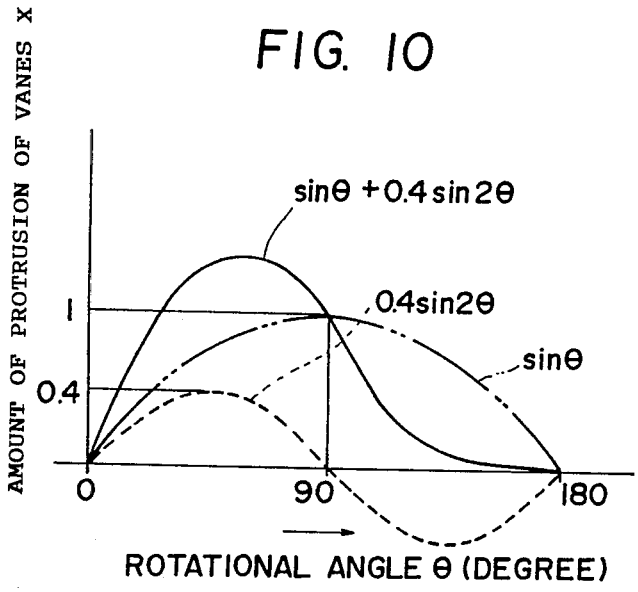
FIG. 10 is a view similar to FIG. 4, but showing a fourth embodiment of the invention.
Figure 11:
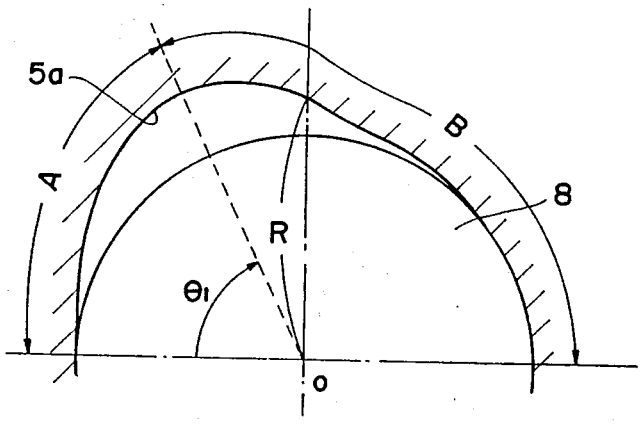
FIG. 11 is a view similar to FIG. 5, but showing the cam profile based upon the characteristic of FIG. 10.

FIGS. 10 and 11 show a fourth embodiment of the invention. According to this embodiment, the vane protrusion amount X is calculated by the following single equation:

$$X = c(\sin\theta + d \sin 2\theta)$$

wherein c is a constant which determines the maximum protrusion amount of the vanes, and d is a value set so as to satisfy the aforementioned requirements, preferably within a range from 0.3–0.4. In this embodiment, the value d is set at 0.4. Thus, the distance R between the center 0 of the rotor 8 and the camming inner peripheral surface 5*a* is expressed as follows:

$$R = Ro + c(\sin\theta + d \sin 2\theta) = Ro + c(\sin\theta + 0.4 \sin 2\theta)$$

The curve of FIG. 10 is calculated by this equation and is therefore a combination or synthetic curve of two sine curves, upon which the cam profile of FIG. 11 is based.

Since in any of the second—fourth embodiments the cam profile of the camming inner peripheral surface 5a is obtained by the single equation, the surface 5a is formed of a single sine curve or a combination of two or more sine curves or a combination of a sine curve and a cosine curve, extending smoothly continuously over the whole circumferential length of the one cycle performing portion, thus being free from jumping of the vanes which would otherwise cause chattering of the vanes and damage to the vanes.

Although the foregoing embodiments are applied to the double pumping chamber type, the invention may equally be applied to the single pumping chamber type, with similar excellent results.

What is claimed is:

1. In a vane compressor comprising: a pump housing having an endless camming inner peripheral surface; a cylindrical rotor rotatably received within said pump housing, said rotor having an outer peripheral surface, a plurality of axial slits being formed in said outer peripheral surface; a plurality of vanes radially movably fitted in said axial slits of said rotor; and a drive shaft coupled to said rotor for causing rotation of said rotor together therewith; whereby rotation of said rotor causes said vanes to slidingly move along said endless camming inner peripheral surface of said pump housing in a predetermined circumferential direction to define at least one pumping chamber between inner surfaces of said pump housing, the outer peripheral surface of said rotor and said vanes, for performing suction, compression and discharge of fluid;

the improvement wherein:

said endless camming inner peripheral surface of said pump housing has at least one portion for performing one cycle of suction, compression and discharge of fluid in cooperation with said vanes and said rotor, said at least one portion having a cam profile including:

an increasing radius portion along which the amount of protrusion of each vane from the rotor gradually increases with movement of the vane; and a decreasing radius portion along which the amount of protrusion of each vane from the rotor gradually decreases with movement of the vane;

said increasing radius portion and said decreasing radius portion being continuously arranged in the order mentioned and in the moving direction of said vanes;

said increasing radius portion terminating in a first half of the whole circumferential length of said one cycle performing portion of said endless camming inner peripheral surface of said pump housing;

said cam profile of said one cycle performing portion of said endless camming inner peripheral surface being defined by only a single equation throughout the whole circumferential length of said one cycle performing portion of said camming inner peripheral surface from a starting end to a terminating end thereof.

2. The vane compressor as claimed in claim 1, wherein said cam profile of said one cycle performing portion of said endless camming inner peripheral surface is such that the distance between the camming inner peripheral surface at said one cycle performing portion thereof and the center of said rotor varies along a sine curve calculated by said single equation and extending continuously over the whole circumferential length of said one cycle performing portion.

3. The vane compressor as claimed in claim 1, wherein said cam profile of said one cycle performing portion of said endless camming inner peripheral surface is such that the distance between the camming inner peripheral surface at said one cycle performing portion thereof and the center of said rotor varies along a synthetic curve of two sine curves calculated by said single equation and extending continuously over the whole circumferential length of said one cycle performing portion.

4. The vane compressor as claimed in claim 1, wherein said cam profile of said one cycle performing portion of said endless camming inner peripheral surface is such that the distance between the camming inner peripheral surface at said one cycle performing portion thereof and the center of said rotor varies along a synthetic curve of a sine curve and a cosine curve calculated by said single equation and extending continuously over the whole circumferential length of said one cycle performing portion.

5. The vane compressor as claimed in claim 1, wherein said single equation is:

$$R = \mathrm{Ro} + a \sin^m\theta \times \cos^n \frac{\theta}{2}$$

where

R=the distance between the center of the rotor and the camming inner peripheral surface, Ro=the radius of the rotor, $$a \sin^m\theta \times \cos^n \frac{\theta}{2} = \text{the amount of protrusion the vane,}$$

$\theta$=the angle at which tip of the vane lies apart from the starting end of the one cycle performing portion with respect to the rotor center, a=a constant determining the maximum amount of protrusion, and m, n=constants determining the length proportion between the increasing radius portion and the decreasing radius portion.

6. The vane compressor as claimed in claim 1, wherein said single equation is:

$$R = Ro + b\left(\sin^m \frac{\theta}{2} - \sin^n \frac{\theta}{2}\right)$$

where

R=the distance between the center of the rotor and the camming inner peripheral surface, Ro=the radius of the rotor, $$b\left(\sin^m \frac{\theta}{2} - \sin^n \frac{\theta}{2}\right) = \text{the amount of protrusion the vane,}$$

$\theta$=the angle at which tip of the vane lies apart from the starting end of the one cycle performing portion with respect to the rotor center, b=a constant determining the maximum amount of protrusion, and m, n=constants determining the length proportion between the increasing radius portion and the decreasing radius portion.

7. The vane compressor as claimed in claim 1, wherein said single equation is:

$$R=Ro+c\ (\sin\theta+d\ \sin 2\theta)$$

where

R=the distance between the center of the rotor and the camming inner peripheral surface, Ro=the radius of the rotor, $c\ (\sin\theta+d\ \sin 2\theta)$=the amount of protrusion the vane, $\theta$the angle at which tip of the vane lies apart from the starting end of the one cycle performing portion with respect to the rotor center, c=a constant determing the maximum amount of protrusion, and d=a constant determining the length proportion between the increasing radius portion and the decreasing radius portion.

8. The vane compressor as claimed in claim 1, wherein said single equation defines a curve representing the distance between the center of the rotor and said camming inner peripheral surface, which is a function of the angle at which tip of said vane lies apart from the starting end of the one cycle performing portion with respect to the rotor center, a peak of said curve defined by said single equation being located closer to the starting end with respect to a middle angle position between the starting end and the terminating end of the one cycle performing portion.

9. In a vane compressor comprising: a pump housing having an endless camming inner peripheral surface; a cylindrical rotor rotatably received within said pump housing, said rotor having an outer peripheral surfce, a plurality of axial slits being formed in said outer peripheral surface; a plurality of vanes radially movably fitted in said axial slits of said rotor; and a drive shaft coupled to said rotor for causing rotation of said rotor together therewith; whereby rotation of said rotor causes said vanes to slidingly move along said endless camming inner peripheral surface of said pump housing in a predetermined circumferential direction to define at least one pumping chamber between inner surfaces of said pump housing, the outer peripheral surface of said rotor and said vanes, for performing suction, compression and discharge of fluid;

the improvement wherein:

said endless camming inner peripheral surface of said pump housing has at least one portion for performing one cycle of suction, compression and discharge of fluid in cooperation with said vanes and said rotor, said at least one portion having a cam profile including:

an increasing radius portion along which the amount of protrusion of each vane from the rotor gradually increases with movement of the vane; and a decreasing radius portion along which the amount of protrusion of each vane from the rotor gradually decreases with movement of the vane;

said increasing radius portion and said decreasing radius portion being continuously arranged in the order mentioned and in the moving direction of said vanes;

said increasing radius portion terminating in a first half of the whole circumferential length of said one cycle performing portion of said endless camming inner peripheral surface of said pump housing;

said cam profile of said one cycle performing portion of said endless camming inner peripheral surface being defined by only a single equation throughout the whole circumferential length of said one cycle performing portion of said camming inner peripheral surface from a starting end to a terminating end thereof; and wherein said single equation is:

$$R = Ro + h \sin\left[180^{\frac{n}{m}} \times \theta^{(1-\frac{n}{m})}\right]$$

where

R=the distance between the center of the rotor and the camming inner peripheral surface, Ro=the radius of the rotor, $h\ sin\ [180^{n/m} \times \theta^{(1-n/m)}]$=the amount of protrusion the vane, $\theta$=the angle at which tip of the vane lies apart from the starting end of the one cycle performing portion with respect to the rotor center, h=a constant determining the maximum amount of protrusion, and m, n=constants determining the length proportion between the increasing radius portion and the decreasing radius portion.

* * * * *